US005988639A

United States Patent [19]

Seldin

[11] Patent Number: 5,988,639

[45] Date of Patent: Nov. 23, 1999

[54] PUZZLE DEVICE

[75] Inventor: Edward B. Seldin, Cambridge, Mass.

[73] Assignee: Kinderworks Corporation, Somersworth, N.H.

[21] Appl. No.: 09/023,820

[22] Filed: Feb. 13, 1998

[51] Int. Cl.[6] ..... A63F 9/12

[52] U.S. Cl. ..... 273/156; 273/160

[58] Field of Search ..... 273/153 R, 153 S, 273/155, 156, 157 R, 159, 160, 158; D21/479, 482

[56] References Cited

U.S. PATENT DOCUMENTS

| | | | |
|---|---|---|---|
| D. 172,310 | 5/1954 | Riddle | D34/15 |
| 964,688 | 7/1910 | Parker . | |
| 977,265 | 11/1910 | Von Brethorst . | |
| 1,050,141 | 1/1913 | Joy | 273/156 |
| 1,095,908 | 5/1914 | Messenger . | |
| 1,099,159 | 6/1914 | Banic | 273/160 |
| 1,270,181 | 6/1918 | McElveen | 273/160 |
| 1,338,973 | 5/1920 | Brown . | |
| 1,542,148 | 6/1925 | Kramariuk | 273/160 |
| 2,859,971 | 11/1958 | Grant et al. | 273/158 |
| 3,758,114 | 9/1973 | Ludwig | 273/159 |
| 3,813,841 | 6/1974 | Tsurumi | 273/160 |
| 3,885,793 | 5/1975 | Vaughn | 273/158 |
| 4,198,053 | 4/1980 | Rao | 273/160 |
| 5,114,377 | 5/1992 | Mercuri et al. | 446/487 |
| 5,405,135 | 4/1995 | Embo | 273/157 R |
| 5,413,519 | 5/1995 | Simon | 446/487 |
| 5,511,391 | 4/1996 | Verstraeten . | |

FOREIGN PATENT DOCUMENTS

| | | |
|---|---|---|
| 0090254 | 3/1988 | European Pat. Off. . |
| 13328 | 6/1891 | United Kingdom . |

*Primary Examiner*—Steven Wong
*Attorney, Agent, or Firm*—Hayes Soloway Hennessey Grossman & Hage PC

[57] ABSTRACT

A puzzle toy device having a plurality of "C"-shaped elements assembled together orthogonally, in three equal groups, to form a cubic structure. Each of the elements is provided with an opening therein to permit another element to pass therethrough. One of the groups of elements are formed together with their respective openings in alignment, while the other two groups of elements are assembled together with their openings alternating with respect to one another. A central link, in the group normal to the aligned openings is provided as a keyway which permits that element, and then subsequent elements to be backed off, thus providing a solution to the puzzle.

16 Claims, 1 Drawing Sheet

PUZZLE DEVICE

FIELD OF THE INVENTION

The present invention is related to puzzle toys. More particularly, the present invention is related to a puzzle toy device that is challenging to solve and that can be manipulated by hand to provide the user with visual and tactile stimulation and improving manual dexterity.

BACKGROUND OF THE INVENTION

Many hand-manipulated puzzles exist in the prior art that comprise self-contained elements formed of substantially rigid material of uniform cross-section in varying configurations. Moreover, many puzzle devices exist in the art that provide a user with tactile and visual stimulation, while providing a challenging puzzle that gives the user hours of entertainment.

For example, U.S. Pat. No. 5,413,519, issued to Simon discloses an interconnected ring toy comprising a plurality of interconnected rings, each ring being interconnected to every other ring, such that movement is restricted. As another example, U.S. Pat. No. 3,885,793 issued to Vaughn provides a puzzle formed of self-contained elements from rigid wire-like material that are interlocked together by hand manipulation.

SUMMARY OF THE INVENTION

It is a primary object of the present invention to provide a puzzle device that can be manipulated by hand for visual and tactile stimulation; and to provide a puzzle toy device that has at least one solution in assembly and disassembly of the puzzle to provide hours of visual and tactile enjoyment to a user. Furthermore, the puzzle device, in one embodiment can be worn as an adornment or used as a charm or decoration on a key chain, etc.

Accordingly, in a preferred embodiment, the present invention provides a puzzle toy device comprising a plurality of C-shaped elements that are assembled together in orthogonal groups to form a cube. In one preferred embodiment, the plurality of C-shaped elements comprises a plurality of substantially identical C-shaped rectangular elements, each having a uniform cross-sectional diameter. Also in the preferred embodiment, each C-shaped rectangular element is provided with an opening or gap approximately equal to the cross-sectional diameter of the elements. Fully assembled, the puzzle toy device of the present invention provides three groups of elements orthogonally arranged and interlocked together to form a cubic structure where each group is bound together by the other two groups.

Optionally, one or more of the elements may be provided with an eyelet or the like so that the puzzle device can be removably attached to a keychain, etc.

It will be appreciated by those skilled in the art that although the following Detailed Description will proceed with reference being made to preferred embodiments and methods of use, the present invention is not intended to be limited to these preferred embodiments and methods of use. Rather, the present invention is of broad scope and is intended to be limited as only set forth in the accompanying claims.

Other features and advantages of the present invention will become apparent as the following Detailed Description proceeds, and upon reference to the Drawings, wherein like numerals depict like parts, and wherein:

DETAILED DESCRIPTION OF PREFERRED EMBODIMENTS

Figure 1:
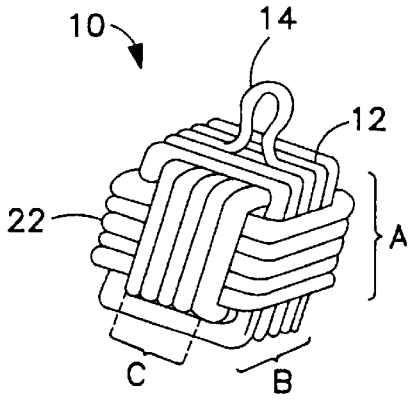
FIG. 1 is an isometric view of the puzzle toy device of the present invention.

FIG. 1 is an perspective view of the puzzle toy device of the present invention according to a preferred embodiment. Interconnecting puzzle toy device 10 includes a plurality of C-shaped rectangular elements 12 that are assembled together in substantially orthogonal groups A, B and C to form a cubic structure. Preferably, the plurality of C-shaped elements 12 are substantially identical in size and rectangular in shape. Also preferably, to provide a puzzle that has a relatively difficult solution, the puzzle toy 10 of the present invention comprises 15 substantially identical C-shaped elements 12, arranged orthogonally as above, with five to a side A, B and C. Alternatively, however, one or more of such elements 14 can include an eyelet or the like so that the puzzle device 10 can be removably attached to a keychain, etc.

Figure 2:
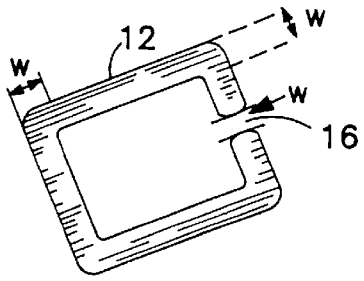
FIG. 2 is a side elevational view of an individual element of the puzzle toy device of the present invention.

FIG. 2 is a side elevational view of a basic C-shaped element 12 of the present invention. In a preferred embodiment, element 12 is a C-shaped element having a generally uniform, circular cross-sectional width W and having an opening 16 in side end thereof C-shaped element 12 is essentially a round wire member forming a C-shaped ring. Alternatively, element 12 can have a generally uniform, rectangular or ovular cross-sectional width W. Element 12 has a generally rectangular shape having a length transverse to opening 16 which is slightly larger than the length parallel to opening 16. As seen in FIG. 2, the opening width 16 must be fractionally less than W, so that other elements 12 of the puzzle 10 slide in and out of the opening 16 (described below) with slight impedance. Elements 12 can be formed of any dimensionally stable material such as a rigid plastic, metal, or wood; preferably, however, for increased tactile feel and durability, elements 12 are formed of metal. Also preferably, each element 12 is of unitary construction.

Figure 3:
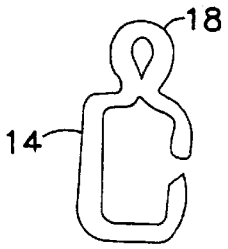
FIG. 3 is a perspective view of another embodiment of an individual element of the puzzle toy device of the present invention.

FIG. 3 is a side elevational view of an alternative embodiment to one or more of the elements 12 described above. Element 14 is essentially identical to element 12 (described above) and is dimensionally configured similarly to the element 12. Additionally, however, element 14 has an eyelet 18 or the like that, as shown in FIG. 3, can be formed integrally with element 14. Alternatively, eyelet 18 can be a separate piece that is attached to element 14 in a conventional manner (e.g., soldering, brazing, glue, etc.). The dimensions of eyelet 18 are not important, so long as eyelet 18 does not interfere with assembly and disassembly of the puzzle toy 10 (described below), and is merely provided as a convenience to attach the assembled puzzle toy 10 to a keychain, etc.

A primary object of the present invention is to provide a puzzle toy 10 that can be assembled and disassembled repetitively, and to provide a relatively complex puzzle toy 10 that will engage the user to attempt to solve the puzzle 10. Referring again to FIG. 1, the assembled, solved puzzle toy 10 of the preferred embodiment is shown. The interlocking nature of the puzzle 10 dictates that the three groups of elements 12 (i.e., groups A, B and C) be assembled such that each group of elements, and indeed each individual element 12, is both simultaneously bound by another group of elements and binding to a different group of elements. In the assembled puzzle toy 10, there should be essentially no relative movement of any of the individual elements 12 (and, alternatively, 14). The elements 12 are assembled together orthogonally, five to a side in groups A, B and C, respectively, to form the generally cubic structure shown. At least one group of elements, A, B, or C, are assembled together such that their respective openings 16 are aligned. The other two groups of elements are assembled with openings 16 alternating with respect to one another. The central element 22 in the group that is normal to the group having the aligned openings acts as a "keyway" which permits that link, and then subsequent links, one at a time, in that group, to be backed out. This, in essence, is the solution to the puzzle toy 10, as described below.

Figure 4:
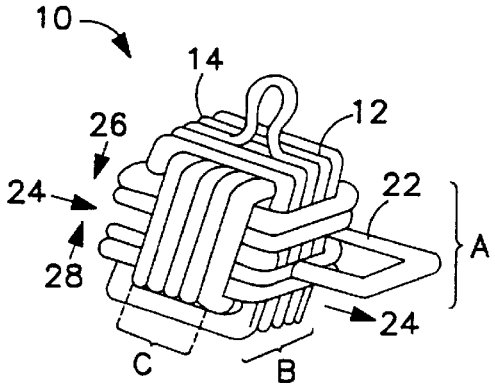
FIG. 4 is a perspective view of a starting position to disassemble the puzzle toy device of the present invention.

Referring now to FIG. 4, complete assembly and disassembly (and therefore a solution to the puzzle toy 10) will be described below.

Disassembly

Disassembly of the puzzle toy 10 starts with finding the element 22 that is normal to the group of element having their respective openings 16 in alignment. In the example shown in FIG. 4, group B has all of the openings 16 aligned. Of course, any one of the groups A, B or C could have its openings 16 in alignment. That element 22 normal to the aligned openings 16 is then forced (indicated by arrows 24) through the openings 16, into the puzzle toy 10 until it gets caught on the side opposite the side of the aligned openings 16. Next, another element in the same group (e.g., group A) is forced up 28, or down 26, to align that element with the aligned openings 16. Then, that element is forced into the puzzle device 10 until it gets caught on the side opposite the side of the aligned openings 16. This process repeats until all the elements 12 in that group are removed through the aligned openings 16. When this process is complete, all of the elements in the other group (e.g., group C) will simple fall out of the puzzle toy 10 because they will no longer be bound by the non-aligned group (e.g., group A). Lastly, all of the elements can be disassociated from one another, leaving 15 individual elements 12 that are to be assembled to form the puzzle toy 10.

Assembly

Assembly of the individual elements 12 to form the toy puzzle 10 is essentially the reverse of the disassembly process, described above. Note, however, that a group consisting of the elements 12 having the aligned openings must be completely formed first. Then other elements in each group can be inserted into the openings and maneuvered into its appropriate location.

Figure 5:
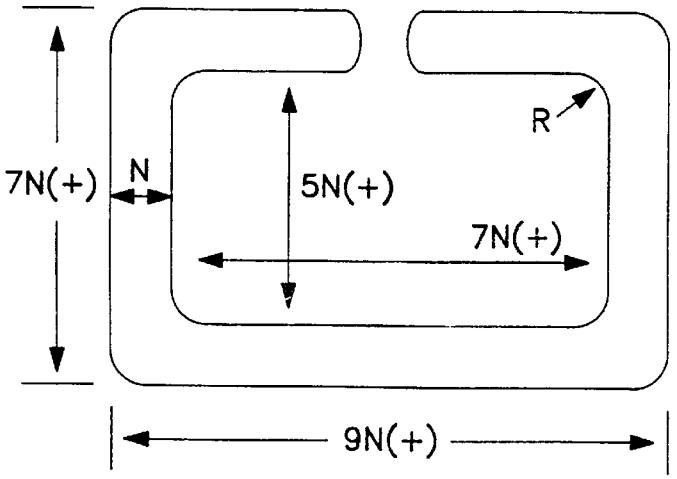
FIG. 5 is an enlarged view, similar to FIG. 2, of an individual element of the puzzle toy device of the present invention.

FIG. 5 illustrates a preferred puzzle element 12 made in accordance with the present invention, and formed on wound wire stock having a dimension N. Each link should have an inside quarter radius R of approximately N/2, with an inside dimension which is a multiple of N+ where + is a small added increment. For example, in a preferred embodiment as illustrated in FIG. 5, each link has an inside dimension of 5 N+ by 7 N+, the inside dimensions being made slightly oversized so as to permit the several parts to fit inside one another without too much frictional hindrance. This gives a link with an outside dimension of 7 N+ by 9 N+. The gap W should have a dimension that closely approximates N, but may be slightly smaller than N for a snap fit, provided the links have some resilient flexibility.

Of course, other solutions to the puzzle toy device 10 of the present invention will become apparent as users become accustomed to the toy, and all such modifications are part of the scope of the present invention.

Thus, it is evident that there has been provided a puzzle toy device that fully satisfy both the aims and objectives hereinbefore set forth. It will be appreciated that although specific embodiments and methods of use have been presented, many modifications, alternatives and equivalents are possible. For example, while the preferred embodiment illustrated comprises five elements 12 per group, fewer or greater number of elements per group could be employed. Accordingly, the present invention is intended to cover all such alternatives, modifications, and equivalents as may be included within the spirit and broad scope of the invention as defined only by the hereafter appended claims.

What is claimed is:

1. A puzzle toy device comprising three groups having a plurality of elements in each group, said groups being arranged substantially normal to each other to form a cubic structure, each said element being generally C-shaped and having an opening formed therein to accommodate a cross sectional width of each of each other said element, wherein each said element comprises a C-shaped rectangle.

2. A device as claimed in claim 1, wherein each of said groups comprise at least five elements.

3. A device as claimed in claim 1, wherein at least one group of said elements having said openings in alignment.

4. A device as claimed in claim 1, wherein at least one group of said elements having said openings alternating with respect to one another.

5. A device as claimed in claim 1, wherein each said element comprises a parallel piped in shape.

6. A device as claimed in claim 1, wherein each said element having a uniform cross-sectional diameter.

7. A device as claimed in claim 1, wherein at least one of said elements has an eyelet formed thereon.

8. A device as claimed in claim 1, wherein each said element is of unitary construction.

9. A device as claimed in claim 1, wherein each said element is substantially identical.

10. A device as claimed in claim 1, wherein each said group of elements being held in said cubic structure by each of the other groups in an interlocking manner.

11. A device as claimed in claim 1, and comprising three groups of five elements each.

12. A device as claimed in claim 1, wherein each element is formed of a dimensionally stable material.

13. A device as claimed in claim 12, wherein said dimensionally stable material is selected from the group consisting of a metal, a rigid plastic, and wood.

14. A puzzle toy device comprising three groups having a plurality of elements in each group, said groups being arranged substantially normal to each other to form a cubic structure, each said element being generally a C-shaped rectangle and having an opening formed therein to accommodate a cross sectional width of each of each other said element, wherein each of said groups comprise at least five elements.

15. A puzzle toy device comprising three groups having a plurality of elements in each group, said groups being arranged substantially normal to each other to form a cubic structure, each said element being generally a C-shaped rectangle and having an opening formed therein to accommodate a cross sectional width of each of each other said element, wherein each said element comprises a parallel piped in shape.

16. A puzzle toy device comprising three groups having a plurality of elements in each group, said groups being arranged substantially normal to each other to form a cubic structure, each said element being generally a C-shaped rectangle and having an opening formed therein to accommodate a cross sectional width of each of each other said element, and comprising three groups of five elements each.

* * * * *